US008266922B2

(12) United States Patent
Whitaker et al.

(10) Patent No.: US 8,266,922 B2
(45) Date of Patent: Sep. 18, 2012

(54) LIQUID DISPENSING APPARATUS AND METHOD

(75) Inventors: Toby Whitaker, LaGrange, KY (US); Mark Wayne Wilson, Simpsonville, KY (US); John Joseph Roetker, Louisville, KY (US)

(73) Assignee: General Electric Company, Schenectady, NY (US)

( * ) Notice: Subject to any disclaimer, the term of this patent is extended or adjusted under 35 U.S.C. 154(b) by 75 days.

(21) Appl. No.: 11/559,984

(22) Filed: Nov. 15, 2006

(65) Prior Publication Data

US 2008/0110194 A1 May 15, 2008

(51) Int. Cl.
*F25D 3/00* (2006.01)

(52) U.S. Cl. ..... 62/389

(58) Field of Classification Search ..... 62/389, 62/92, 125, 129, 272, 285, 288, 290; 99/279; 604/19, 22, 27–28, 150–151, 294; 606/162, 606/167, 170, 171, 185; 141/4, 45–48, 86, 141/94–97, 115–116, 119–120, 192, 198, 141/387; 137/565

See application file for complete search history.

(56) References Cited

U.S. PATENT DOCUMENTS

| | | | | |
|---|---|---|---|---|
| 3,014,620 | A | 12/1961 | Moore | |
| 3,798,895 | A * | 3/1974 | Meijer et al. | 60/530 |
| 4,077,545 | A | 3/1978 | Karls | |
| 4,207,994 | A | 6/1980 | Offlee, Sr. | |
| 4,391,459 | A | 7/1983 | Wicke et al. | |
| 4,424,767 | A | 1/1984 | Wicke et al. | |
| 4,432,556 | A * | 2/1984 | Green et al. | 277/434 |
| 4,513,887 | A | 4/1985 | Wicke et al. | |
| 4,646,528 | A * | 3/1987 | Marcade et al. | 62/127 |
| 5,395,014 | A | 3/1995 | Burrows | |
| 5,511,388 | A | 4/1996 | Taylor et al. | |
| 5,819,547 | A * | 10/1998 | Oh | 62/188 |
| 5,855,120 | A | 1/1999 | Kim | |
| 6,207,046 | B1 | 3/2001 | Yamashita et al. | |
| 6,324,850 | B1 | 12/2001 | Davis | |
| 6,327,869 | B1 * | 12/2001 | Shapiro et al. | 62/347 |
| 6,622,509 | B2 | 9/2003 | Stich et al. | |
| 6,847,782 | B1 | 1/2005 | Kovacs | |

(Continued)

FOREIGN PATENT DOCUMENTS

FR 2671863 A1 * 7/1992

(Continued)

OTHER PUBLICATIONS

NPL—The Engineering Toolbox Webpage; Description of types of pumps.*

(Continued)

*Primary Examiner* — Frantz Jules
*Assistant Examiner* — Emmanuel Duke
(74) *Attorney, Agent, or Firm* — Global Patent Operation; Douglas D. Zhang

(57) ABSTRACT

A liquid dispensing apparatus for a refrigerator includes a storage tank in fluid communication with a water inlet. The storage tank is configured to retain water flowing into the water inlet. An auxiliary tank is in fluid communication with the storage tank. The auxiliary tank includes a housing with a piston disposed therein. The piston is movable in a first direction to fill a portion of an interior volume of the housing with water and in a second direction to expel water from the interior volume of the housing.

17 Claims, 5 Drawing Sheets

U.S. PATENT DOCUMENTS

| | | | | |
|---|---|---|---|---|
| 6,877,965 | B2 * | 4/2005 | McCall et al. | 417/472 |
| 6,912,867 | B2 | 7/2005 | Busick | |
| 7,028,725 | B2 | 4/2006 | Hooker | |
| 7,188,479 | B2 | 3/2007 | Anselmino et al. | |
| 7,269,968 | B2 * | 9/2007 | Harder et al. | 62/389 |
| 2003/0140964 | A1 | 7/2003 | O'Donnell | |
| 2004/0261443 | A1 * | 12/2004 | Crisp et al. | 62/390 |
| 2005/0063839 | A1 * | 3/2005 | Kazumasa | 417/415 |
| 2005/0072178 | A1 * | 4/2005 | Park et al. | 62/389 |
| 2005/0198991 | A1 * | 9/2005 | Harder et al. | 62/389 |
| 2006/0006107 | A1 * | 1/2006 | Olson et al. | 210/198.1 |
| 2007/0068190 | A1 | 3/2007 | Venkatakrishnan et al. | |
| 2007/0074529 | A1 | 4/2007 | Lim | |
| 2007/0093936 | A1 | 4/2007 | Johnson et al. | |
| 2007/0186780 | A1 * | 8/2007 | Clark | 99/275 |
| 2008/0107410 | A1 | 5/2008 | White | |

FOREIGN PATENT DOCUMENTS

| | | | |
|---|---|---|---|
| JP | 61-077763 | * | 4/1986 |

OTHER PUBLICATIONS

U.S. Appl. No. 11/946,693, filed Nov. 28, 2007, John J. Roetker, et al.

Non-Final Office Action issued in connection with U.S. Appl. No. 11/967,807, Sep. 16, 2010.

* cited by examiner

LIQUID DISPENSING APPARATUS AND METHOD

BACKGROUND OF THE INVENTION

The described technology relates to a liquid dispensing apparatus, such as for a refrigerator, and more specifically to a liquid dispensing apparatus configured to dispense heated water, such as for a side-by-side or bottom freezer refrigerator, and a corresponding method.

It is known to provide a refrigerator with a water dispenser that dispenses cooled water (e.g., water cooled to have a temperature less than a temperature at which the water is received into the refrigerator). One type of known refrigerator is a so-called side-by-side refrigerator that includes a freezer section disposed to the side of a fresh food section. In the known side-by-side refrigerator, water flows from a water source exterior to the refrigerator, such as a water line of a building in which the refrigerator is disposed. The water is cooled by a cooling system, in a known manner. The cooled water is dispensed by the cool water dispenser, which is disposed in a door of the freezer section of the refrigerator. By this arrangement, cooled water is immediately available to a user of the refrigerator.

Another type of known refrigerator is a so-called bottom freezer or bottom mount freezer refrigerator which includes a bottom freezer section disposed below a top fresh food section. In a manner similar to that of the known side-by-side refrigerator, in the known bottom freezer refrigerator water from the exterior water source is cooled and dispensed by the cool water dispenser disposed in a door of the fresh food section of the refrigerator.

It may also be desirable, however, to provide heated water (e.g., water having a temperature greater than the temperature at which the water is received into the refrigerator) to the user of a refrigerator. Known refrigerators do not include water dispensers configured to dispense heated water.

BRIEF DESCRIPTION OF EMBODIMENTS OF THE INVENTION

As described herein, embodiments of the invention overcome one or more of the above or other disadvantages known in the art.

In an embodiment, a liquid dispensing apparatus for a refrigerator includes a storage tank in fluid communication with a water inlet. The storage tank is configured to retain water flowing into the water inlet. An auxiliary tank is in fluid communication with the storage tank. The auxiliary tank includes a housing with a piston disposed therein. The piston is movable in a first direction to fill a portion of an interior volume of the housing with water and in a second direction to expel water from the interior volume of the housing.

In another embodiment, a refrigerator includes a first compartment defining a first interior volume, a first door configured to be positioned to permit and impede access to the first interior volume, and a liquid dispensing apparatus configured to dispense water through the first door. The liquid dispensing apparatus includes a storage tank in fluid communication with a water inlet. The storage tank is configured to retain water flowing into the water inlet. An auxiliary tank is in fluid communication with the storage tank. The auxiliary tank includes a housing with a piston disposed therein. The piston is movable in a first direction to fill a portion of an interior volume of the housing with water and in a second direction to expel water from the interior volume of the housing.

In another embodiment, a method of dispensing water from a liquid dispenser disposed in a door of a refrigerator includes moving a piston in a housing of an auxiliary tank in a first direction to expel water from the auxiliary tank, and moving the piston in the housing of the auxiliary tank in a second direction to fill a portion of an interior volume of the auxiliary tank.

BRIEF DESCRIPTION OF THE DRAWINGS

The following figures illustrate examples of embodiments of the invention. The figures are described in detail below.

DETAILED DESCRIPTION OF EMBODIMENTS OF THE INVENTION

Embodiments of the invention are described below, with reference to the figures. Throughout the figures, like reference numbers indicate the same or similar components.

Figure 1:
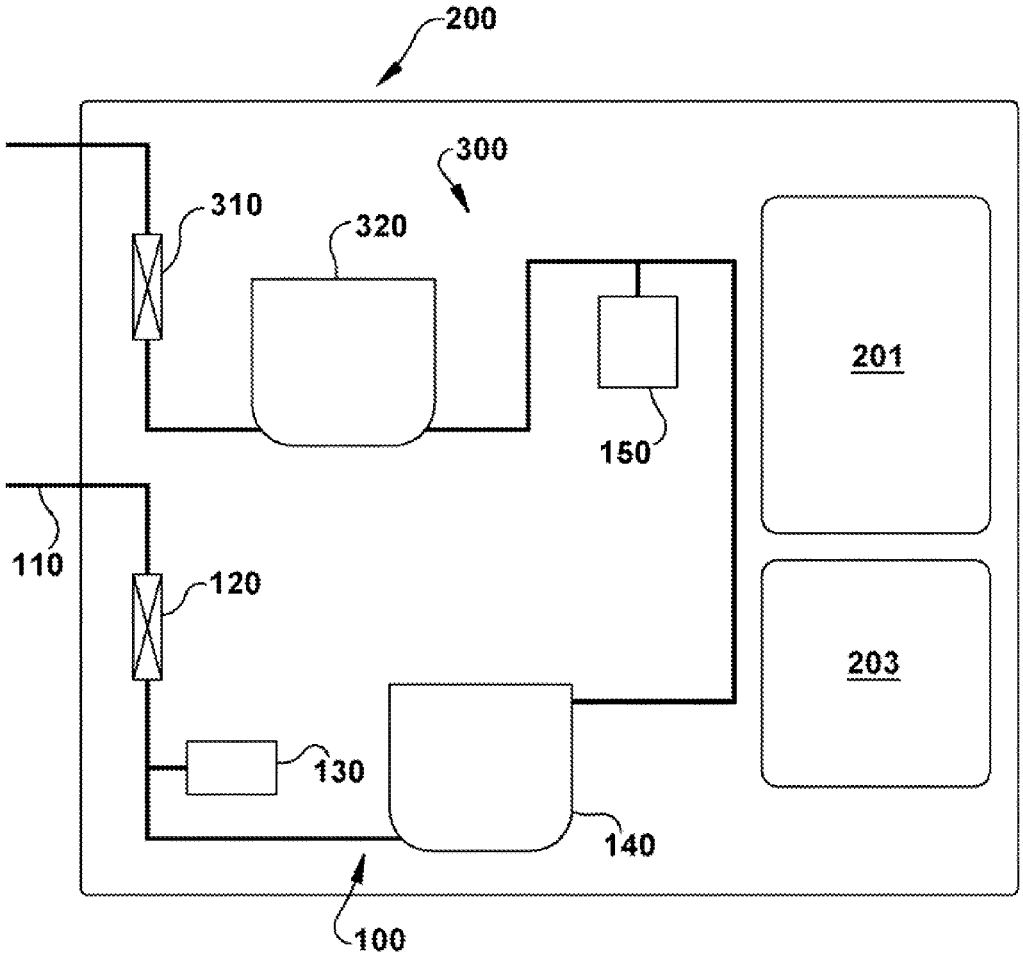
FIG. 1 is a schematic view of a refrigerator including a liquid dispensing apparatus.
Figure 3:
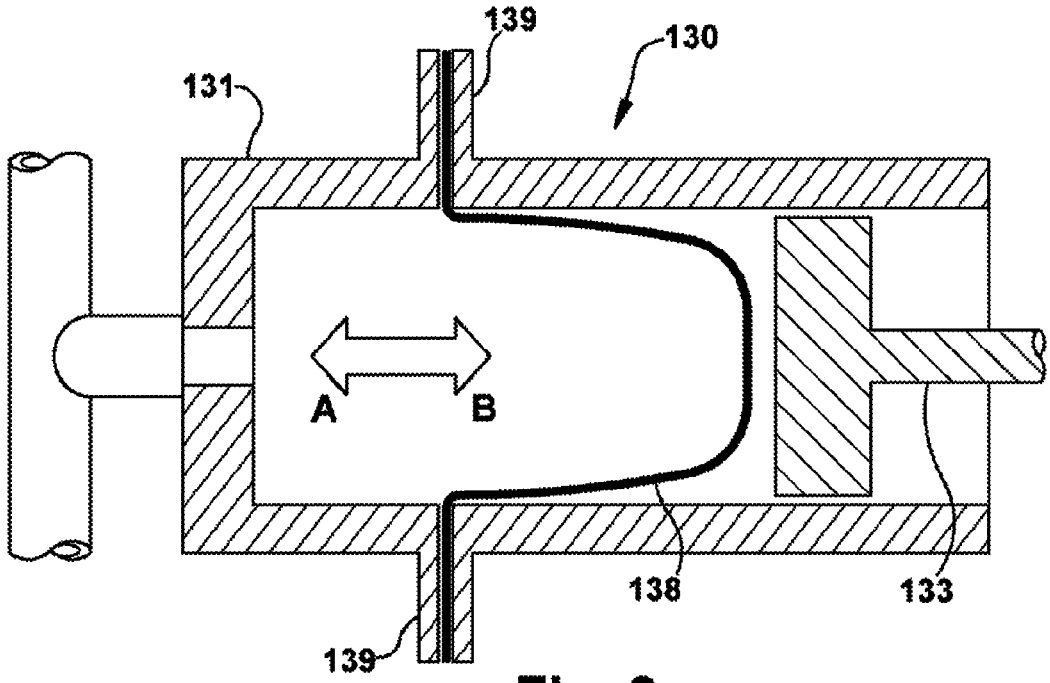
FIG. 3 is a cross sectional view of another embodiment of the auxiliary tank of the liquid dispensing apparatus of FIG. 1.
Figure 4:
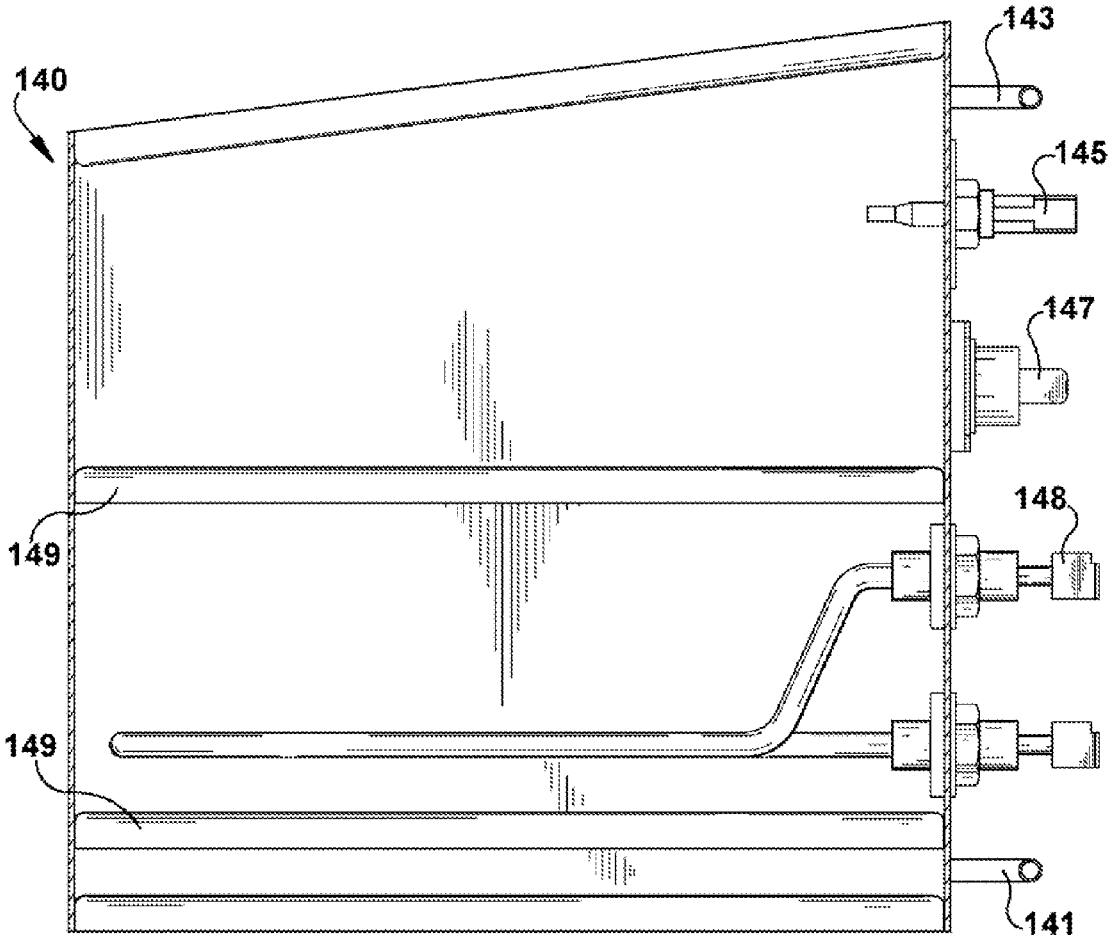
FIG. 4 is a partial cross sectional view of an embodiment of a liquid storage tank of the liquid dispensing apparatus of FIG. 1.

FIG. 1 is a schematic view of a refrigerator including a liquid dispensing apparatus, while FIGS. 3 and 3 are cross sectional views of embodiments of the auxiliary tank of the liquid dispensing apparatus of FIG. 1, and FIG. 4 is a partial cross sectional view of an embodiment of a liquid storage tank of the liquid dispensing apparatus of FIG. 1.

Figure 5:
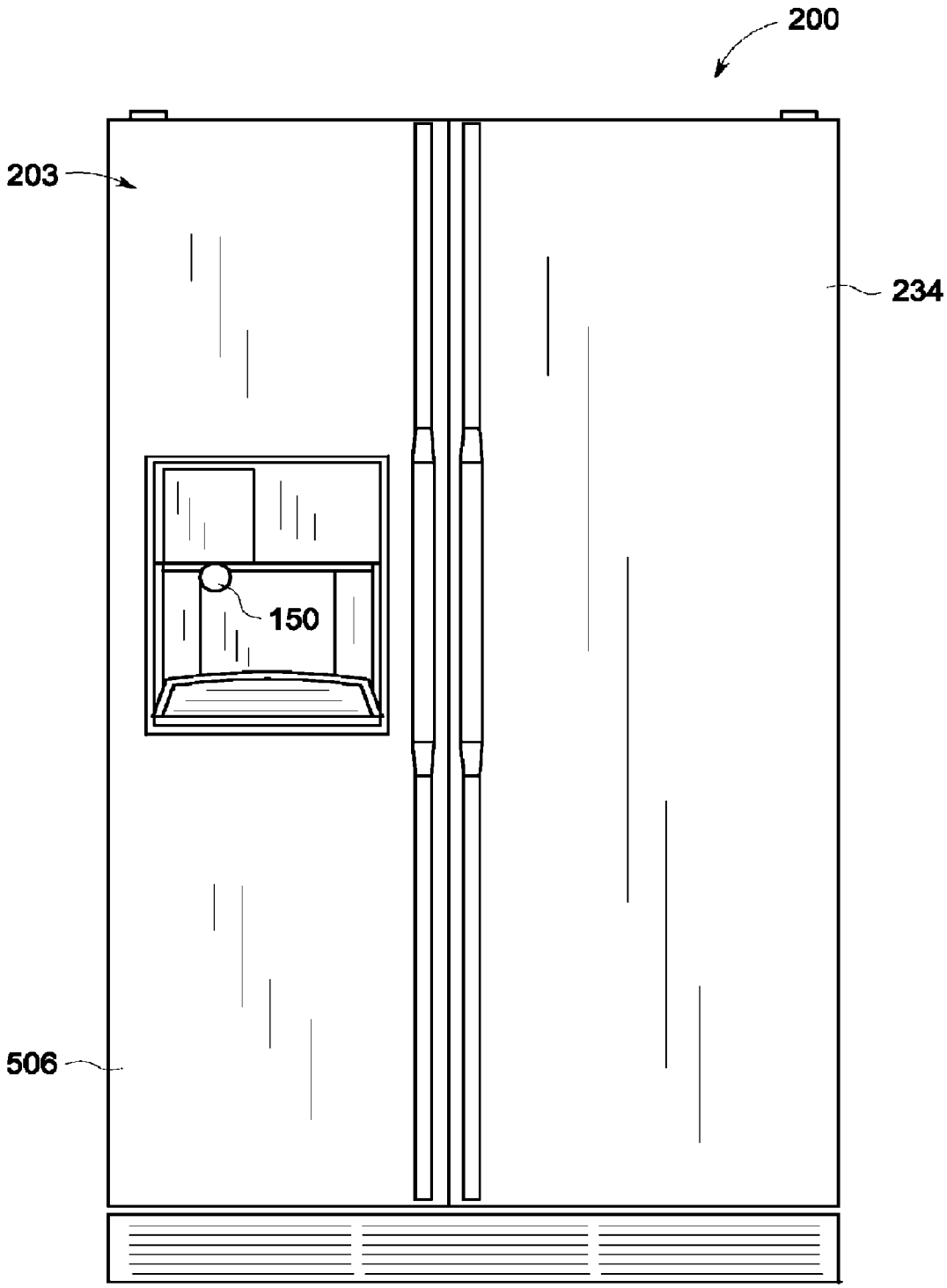
FIG. 5 illustrates one embodiment of an exemplary refrigerator that can be used to practice aspects of the disclosed embodiments.

FIG. 5 illustrates a front view of an exemplary refrigerator 200. While the apparatus is described herein in the context of a specific refrigerator 100, it is contemplated that the herein described methods and apparatus may be practiced in other types of refrigerators. Therefore, as the benefits of the herein described methods and apparatus accrue generally to ice maker controls in a variety of refrigeration appliances and machines, the description herein is for exemplary purposes only and is not intended to limit practice of the invention to a particular refrigeration appliance or machine, such as refrigerator 200. FIG. 5 is a front view of the refrigerator 200 with freezer compartment door 232 (FIG. 6) and fresh food compartment door 234 in a closed position. The freezer door 232 and fresh food door 234 close access openings to fresh food and freezer compartments 203, 201 (FIG. 6), respectively. Freezer door 232 includes a through the door dispenser 150. Dispenser 150 is supplied water by a dispenser assembly, such as, for example, liquid dispensing apparatus 100 (FIG. 1).

Figure 6:
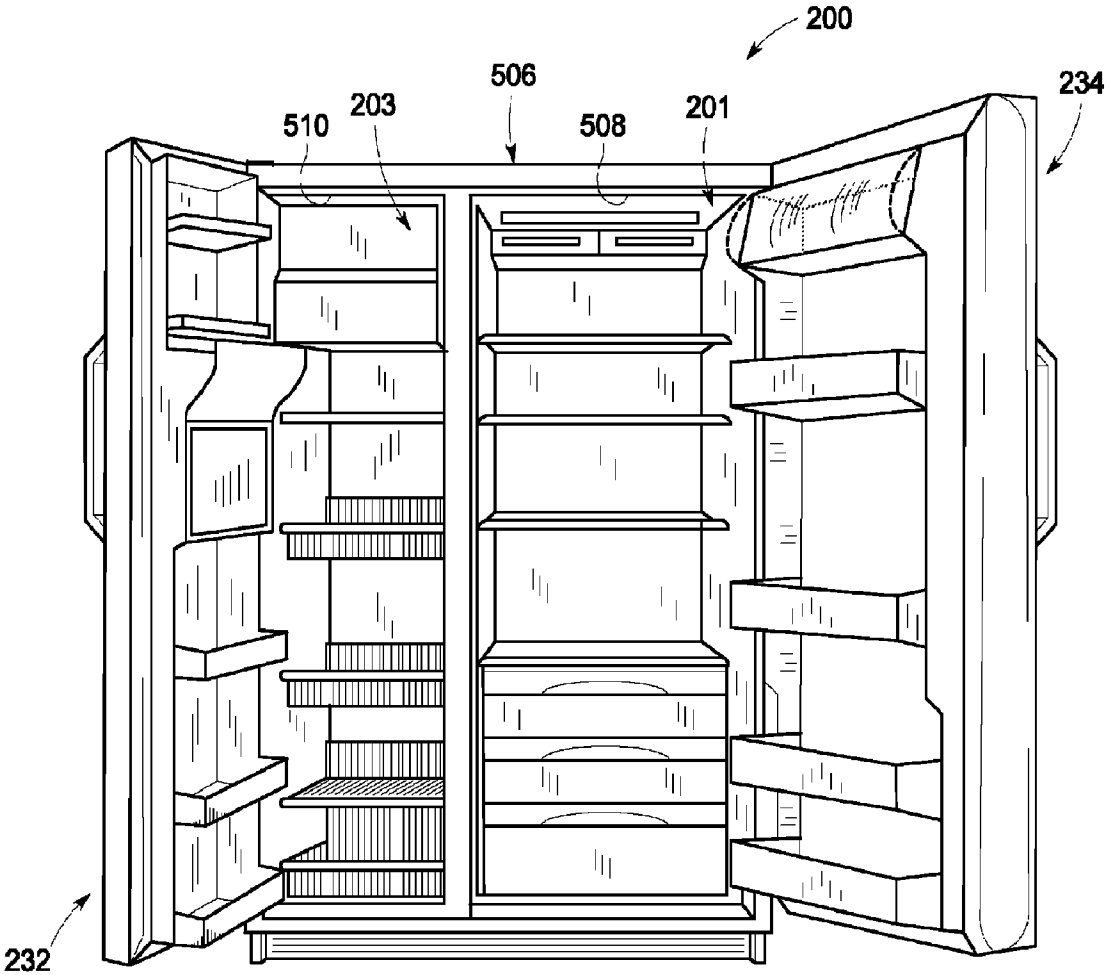
FIG. 6 illustrates an interior view of the refrigerator shown in FIG. 5.

Referring to FIG. 6, freezer compartment 203 and fresh food compartment 201 are arranged side-by-side, however, the benefits of the herein described methods and apparatus accrue to other configurations such as, for example, top and bottom mount refrigerator-freezers. Refrigerator 200 includes an outer case 506 and inner liners 508 and 510. Inner liners 508 and 510 are molded from a suitable plastic material to form freezer compartment 203 and fresh food compartment 201, respectively.

In accordance with embodiments of the invention, the liquid dispensing apparatus 100 of the refrigerator 200 dispenses heated water (e.g., water heated to have a temperature greater than a temperature at which the water is received into the liquid dispensing apparatus 100 and/or into the refrigerator 200). It is contemplated that the liquid dispensing apparatus 100 is disposed in the refrigerator 200 that includes a fresh food compartment 201 having an interior volume that is cooled to a temperature greater than a standard freezing point temperature of water (e.g., greater than 0 degrees Celsius) and a freezer compartment 203 having an interior volume that is cooled to a temperature equal to or less than the standard freezing point temperature of water. Doors are used to permit and impede or prevent access to the interior volume of the fresh food and/or freezer compartments 201 and 203. One or more cooling systems are used to cool the fresh food and freezer compartments 201 and 203 of the refrigerator 200, in a known manner. It is further contemplated that the refrigerator 200 is a so-called side-by-side refrigerator in which the freezer compartment 203 is disposed to the side of the fresh food compartment 201, or is a so-called bottom freezer refrigerator in which the freezer compartment 203 is disposed below the fresh food compartment 201. It is understood, however, that that the liquid dispensing apparatus 100 is not limited to use in any particular refrigerator, but rather can be disposed in various refrigerators in which the fresh food and freezer compartments 201 and 203 are disposed in a variety of positions relative to one another. It is further understood that the refrigerator in which the liquid dispensing apparatus 100 is disposed is not required to have one or only one of each of the fresh food and freezer compartments 201 and 203, but rather can include none, or one or more of each of the fresh food and freezer compartments 201 and 203. By way of non-limiting examples, the liquid dispensing apparatus 100 can be disposed in the refrigerator that includes one or more fresh food compartments 201 and no freezer compartment 203, or that includes one or more freezer compartments 203 and no fresh food compartment 201. Still further, it is understood that the liquid dispensing apparatus 100 is not limited to use in a refrigerator, but rather can be disposed in various environments where one or more advantages provided by the liquid dispensing apparatus 100, as discussed in detail below, are provided.

The liquid dispensing apparatus 100 includes a water inlet 110. The water inlet 110 receives water from a water source exterior to the liquid dispensing apparatus 100. In embodiments of the invention, the water inlet 110 ultimately receives the water from the water source that is exterior to the refrigerator 200 in which the liquid dispensing apparatus 100 is disposed. By way of non-limiting examples, the water inlet 110 can receive water from a water line in a building, house, or enclosure in which the refrigerator 200 is disposed. It is contemplated that the refrigerator 200 can be disposed in a kitchen of a house, and therefore the water line can be a pipe connected to a plumbing system of the house.

It is contemplated that the water inlet 110 can be of various configurations, and can be disposed at various locations within the refrigerator 200. By way of non-limiting examples, the refrigerator 200 can include a valve, with one or more outlets, openable to permit water flow and closable to impede or prohibit water flow, or can be in the form of a fitting, with one or more outlets, to which the water inlet 110 is connected.

In embodiments of the invention shown in the drawings, the refrigerator 200 includes a cool water dispensing apparatus 300 configured to dispense cooled water (e.g., water having a temperature less than the temperature at which the water is received into the cool water dispensing apparatus 300 and/or received into the refrigerator 200). In these embodiments, the water inlet 110 can be connected at various points within the cool water dispensing apparatus 300. By way of non-limiting examples, the water inlet 110 can be connected downstream of a cool water valve 310 openable to permit water flow and closable to impede or prohibit water flow into the cool water dispensing apparatus 300, and upstream of a cool water tank 320 in which water is retained and cooled before being dispensed by the cool water dispensing apparatus 300. In other embodiments, the water inlet 110 can be connected downstream of the cool water tank 320 and upstream of a water dispenser that dispenses the cooled water, such as into a cup, mug or other container of the user of the cool water dispensing apparatus 300 and the refrigerator 200. In still other embodiments, the water inlet 110 can be connected to the main water line of the refrigerator 200 at a position upstream of the cool water valve 310, such that the water inlet 110 is not connected within the cool water dispensing apparatus 300.

It is understood that the water dispenser of the cool water dispensing apparatus 300 can be a component of the liquid dispensing apparatus 100, such that the water dispenser also dispenses the water from the liquid dispensing apparatus 100 in addition to dispensing the cooled water. It is also understood, however, that the water from the liquid dispensing apparatus 100 can be separately dispensed. The separate dispenser can be disposed adjacent to or apart from the water dispenser of the cool water dispensing apparatus 300, can be disposed in a same door or on a same one of the fresh food or freezer compartment 201 or 203, or can be disposed in a different door or on a different one of the fresh food or freezer compartment 201 or 203. By way of non-limiting examples, when the refrigerator 200 is a side-by-side refrigerator, the water dispenser of the cool water dispensing apparatus 300 can be disposed in the door of the freezer compartment 203, and the separate dispenser can be disposed in either the door of the fresh food compartment 201 or a door of the freezer compartment 203. When the refrigerator 200 is a bottom freezer refrigerator, the water dispenser of the cool water dispensing apparatus 300 can be disposed in a first door of the fresh food compartment 201, and the separate dispenser can be disposed in either the first door or a second door of the fresh food compartment 201.

Although the drawings show embodiments of the invention in which the refrigerator 200 includes the cool water dispensing apparatus 300, it is to be understood that the refrigerator 200 that includes the liquid dispensing apparatus 100 does not require the cool water dispensing apparatus 300. Further, the refrigerator 200 that includes the liquid dispensing apparatus 100 can include a different cool water dispensing system, or a different water dispensing system altogether. Still further, it is understood that additional details of the cool water dispensing apparatus 300 are known to those of ordinary skill in the art, and therefore further discussion is not required to completely describe embodiments of the invention, or to enable those or ordinary skill to make or use embodiments of the invention. For these reasons, further details of the cool water dispensing apparatus 300 are not further described, except with respect to the liquid dispensing apparatus 100.

In embodiments of the invention shown in the drawings, the liquid dispensing apparatus 100 includes a liquid valve 120. The liquid valve 120 is openable to permit water flow and closable to impede or prohibit water flow into the liquid dispensing apparatus 100, the liquid valve 120 being operated in a manner similar to the cool water valve 310 of the cool water dispensing apparatus 300. It is understood that the use and operation of the liquid valve 120 is determined by those of ordinary skill in view of the description of embodiments of the invention, and therefore the use and operation are not further described.

In embodiments shown in the drawings, a liquid auxiliary tank 130 is disposed downstream of the water inlet 110 and the liquid valve 120. By this arrangement, the water flowing into the water inlet 110, through the liquid dispensing apparatus 100, can be selectively flowed into and/or out of the liquid auxiliary tank 130, such from the liquid storage tank 140 after initially bypassing the liquid auxiliary tank 130. This selective flow is discussed in further detail below, in which specific embodiments of the liquid auxiliary tank 130 are disclosed. It is understood, however, that the liquid auxiliary tank 130 is not limited to any specific configuration. Rather, the liquid auxiliary tank 130 can be of a variety of configurations, as long as the water is able to selectively flow into the liquid auxiliary tank 130 to drain a portion of the liquid dispensing apparatus 100, as described below.

In embodiments shown in the drawings, a liquid storage tank 140 is disposed downstream of a liquid auxiliary tank 130. By this arrangement, water flowing into the water inlet 110 is retained before being dispensed through a water dispenser of the liquid dispensing apparatus 100. A body of the liquid storage tank 140, which comes into contact with the water retained therein, can be manufactured from a food grade, food safe or drinking water safe, stainless steel material, such as a stainless steel alloy. Inasmuch as the liquid dispensing apparatus 100 dispenses heated water, in embodiments of the invention a liquid heater is disposed in an interior volume of the liquid storage tank 140, to thereby heat the water retained therein. The liquid heater can be a submersible, tubular liquid heater. An exterior of the liquid heater can be manufactured from a food grade, food safe or drinking water safe, stainless steel material or alloy, such as INCOLOY 800, a registered trademark of Inco Alloys International. In alternate embodiments, one or more liquid heaters can be disposed at different locations within the liquid dispensing apparatus 100. By way of non-limiting examples, the liquid heater can be disposed downstream of the water inlet 110 and upstream of the liquid auxiliary tank 130, or downstream of the liquid auxiliary tank 130 and upstream of the liquid storage tank 140, or downstream of the liquid storage tank 140.

The temperature of the water within the liquid storage tank 140 can be controlled in various ways that are known to those of ordinary skill in the art. By way of specific examples, one or more thermistors or thermocouples can be used to monitor the temperature of the water. The temperature can be user selectable or changeable, such that the user can select one or more temperatures between room temperature and a standard boiling point temperature of water (e.g., 100 degrees Celsius) or a temperature below the standard boiling point temperature, or the temperature can be set such that the user is unable to change the temperature of the water.

Although the drawings show exemplary embodiments of the invention, it is to be understood that the embodiments of the invention are not required to include each of the described components of the liquid dispensing apparatus 100, and are not required to include the components in the illustrated order. By way of specific non-limiting examples, the liquid dispensing apparatus 100 can include the liquid auxiliary tank 130 downstream of the liquid storage tank 140. Other orders of components are also permissible.

In embodiments shown in the drawings, a liquid dispenser 150 is disposed downstream of the liquid auxiliary tank 130 and the liquid storage tank 140. As discussed above, the liquid dispenser 150 can be the same dispenser as, or a different dispenser than, the water dispenser of the cool water dispensing apparatus 300. When the liquid dispenser 150 is the same dispenser as that of the cool water dispensing apparatus 300, the liquid dispensing apparatus 100 is connected into the cool water dispensing apparatus 300 upstream of the liquid dispenser 150. It is understood that the connection into the cool water dispensing apparatus 300 can be of various configurations, and can be disposed at various locations within the cool water dispensing apparatus 300. By way of non-limiting examples, when the liquid dispenser 150 is disposed in the door of the freezer compartment 203 of the refrigerator 200 that is a side-by-side refrigerator, the connection can be one of (i) within the door and into the cool water dispensing apparatus 300 behind a housing of the liquid dispenser 150, (ii) within the door and into the cool water dispensing apparatus 300 at various locations between the housing and a bottom hinge of the door, on which the door rotates to permit access to the interior volume of the freezer compartment 203, (iii) within a portion of the refrigerator 200 other than the door, and (iv) within the housing itself. The liquid dispenser 150 can also include separate water outlets for the cooled water from the cool water dispensing apparatus 300 and the heated water from the liquid dispensing apparatus 100. Alternatively, as also discussed above, the liquid dispenser 150 can be separate from the water dispenser of the cool water dispensing apparatus 300, being disposed in another portion of the door of the freezer compartment 203 or in a door of the fresh food compartment 201.

The components of the liquid dispensing apparatus 100, such as but not limited to the water inlet 110, the liquid valve 120, the liquid auxiliary tank 130, the liquid storage tank 140 and the liquid dispenser 150 can be connected to one another in various ways, such that the components of the liquid dispensing apparatus 100 are in fluid communication with each other (e.g., the water is able to flow among the components of the liquid dispensing apparatus 100). By way of non-limiting examples, drinking water safe, heat resistant tubing can be used to connect the components in the order discussed above. The use of particular components and/or types of tubing is determined by those of ordinary skill in view of the description of embodiments of the invention, and therefore the use of such tubing or other components is not further described.

Figure 2:
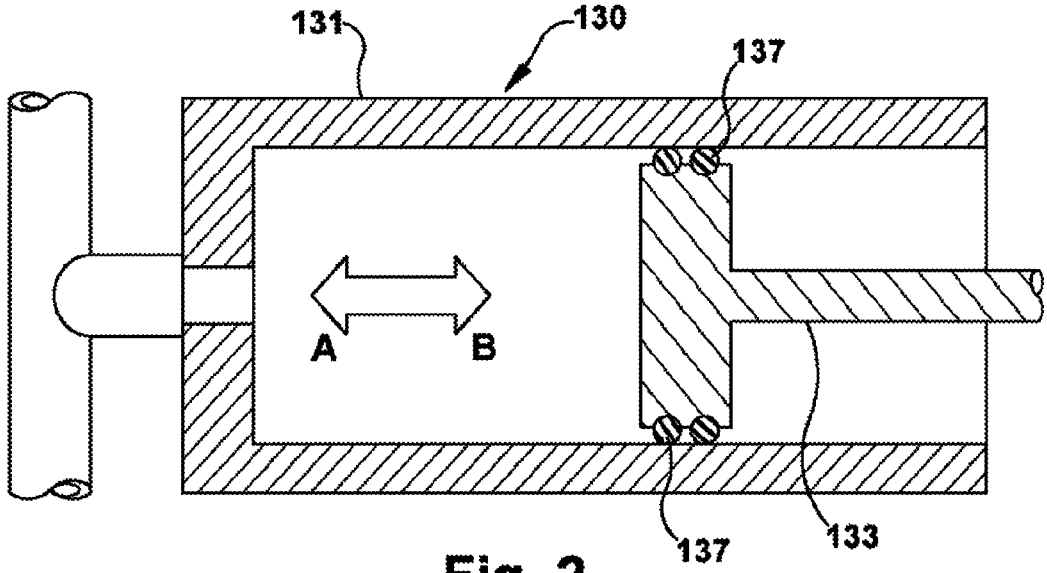
FIG. 2 is a cross sectional view of an embodiment of an auxiliary tank of the liquid dispensing apparatus of FIG. 1.

FIGS. 2 and 3 are cross sectional views of specific embodiments of the liquid auxiliary tank 130. The liquid auxiliary tank 130 includes a housing 131 into which the water is received, in which the water is retained, and from which the water is expelled, before being dispensed by the liquid dispenser 150. Specifically, the housing 131 includes a piston or plunger 133 movably disposed within an interior thereof. By this arrangement, a volume of the interior of the liquid auxiliary tank 130 which retains the water increases or decreases, depending on a position and movement of the piston 133. In particular, when the piston 133 is moved linearly in the direction A, the volume of the interior of the housing 131 is decreased. It is understood that the water disposed in the interior of the housing 131 flows from the liquid auxiliary tank 130 to the liquid storage tank 140. When the liquid storage tank 140 is filled, such as with heated water, the heated water flows from the liquid storage tank 140 to the liquid dispenser 150. By this arrangement, the heated water is delivered from the liquid storage tank 140 to the user of the liquid dispensing apparatus 100 and the refrigerator 200.

When the piston 133 is moved linearly in the direction B, the volume of the interior of the housing 131 is increased. When no water is currently being delivered to the liquid auxiliary tank 130 and the liquid storage tank 140 from upstream of the liquid auxiliary tank 130, such as when a valve is closed upstream of the water inlet 110, the heated water flows from the liquid storage tank 140 into the interior of the housing 131 of the liquid auxiliary tank 130. As a result, the heated water disposed in the liquid dispensing apparatus 100 downstream of the liquid storage tank 140 and upstream of the liquid dispenser 150 flows back towards and/or into the liquid storage tank 140. Thus, in embodiments of the invention in which tubing is disposed between the liquid storage tank 140 and the liquid dispenser 150, the heated water is prevented from remaining in the tubing adjacent the liquid dispenser 150 or from remaining in an entire length of the tubing. By this arrangement, numerous disadvantages are avoided as compared to an apparatus that does not include the liquid auxiliary tank. By way of non-limiting examples, an inadvertent flow (e.g., dripping) of the heated water from the liquid dispenser 150 is prevented. This inadvertent flow might otherwise be caused by expansion of the water in the liquid storage tank 140 as a result of the heating of the water. Further, mixing of the ambient water dispensed by the cool water dispensing apparatus 300 with the heated water remaining in the tubing is prevented.

It is contemplated that in embodiments of the invention, operation of the liquid dispensing apparatus 100 is as follows. When a volume of an interior of the liquid storage tank 140 is partially full, the volume of the interior of the liquid auxiliary tank 130 is full, and the liquid dispenser 150 is actuated, water flows from the liquid auxiliary tank 130 to the liquid storage tank 140. The heated water then flows from the liquid storage tank 140 to the liquid dispenser 150. The water continues to flow from the liquid auxiliary tank 130 to the liquid storage tank 140, until the interior of the liquid auxiliary tank 130 is empty. The liquid valve 120 then opens, and the water flows from the liquid valve 120 into the liquid storage tank 140, bypassing the liquid auxiliary tank 130. When the liquid dispenser 150 is not longer being actuated, the liquid valve 120 closes. Heated water flows from the liquid storage tank 140 back to the liquid auxiliary tank 130, and flows from adjacent the liquid dispenser 150 back to the liquid storage tank 140.

As shown in FIG. 2, in embodiments of the invention, one or more sealing members 137 are disposed on the piston 133. In the embodiments shown in the drawings, the sealing members 137 are two O-ring sealing members. As a result, a fluid tight seal is formed between the piston 133 and the interior of the housing 131, such that the heated water does not flow between the sealing members 137 and the interior of the housing 131. It is understood that movement of the piston 133 increases and decreases the volume of the interior of the housing 131 in the manner discussed above, such that the heated water is moved into and out of the liquid auxiliary tank 130.

As shown in FIG. 3, in embodiments of the invention, a bladder 138 is disposed with the housing 131. In the embodiments shown in the drawings, the bladder 138 is disposed between top and bottom portions of the housing 131, the top and bottom portions including flanges 139 between which the bladder 138 is captured and retained. The bladder 138 can be a fluid tight bladder, such that the heated water does not flow through the bladder 138 to the piston 133. Examples of fluid tight materials from which the bladder 138 can be formed include, but are not limited to, silicone sheet materials.

The bladder 138 moves in response to a corresponding movement of the piston 133. For example, the bladder 138 can be connected to the piston 133 for movement therewith. In another exemplary embodiment, a vacuum or other closed system can be formed with the bladder 138 and the piston 133, such that regardless of whether the bladder 138 is connected to or is in contact with the piston 133, movement of the piston 133 results in movement of the bladder 138. In both cases, it is understood that movement of the piston 133 increases and decreases the volume of the interior of the housing 131 in the manner discussed above, such that the heated water is moved into and out of the liquid auxiliary tank 130.

In the liquid auxiliary tank of FIG. 2, the use of a separate bladder is avoided. In the liquid auxiliary tank of FIG. 3, the piston 133 is not required to maintain a fluid tight seal with the interior of the housing 131, but rather can be spaced apart from the interior of the housing 131. Thus, advantages are provided by each of these embodiments of the liquid auxiliary tank 130.

It is understood by those of ordinary skill that the piston 133 can be moved linearly in the directions A and B in various ways. For example, a linear motion motor (such as a stepper motor) or a solenoid can be used to move the piston 133. Alternately, a pump, such as a reversible pump, can be disposed adjacent an inlet of the liquid auxiliary tank 130. It is understood that the pump can be operated to move the piston 133 and/or the bladder 138 in the directions A and B, as discussed above.

It is contemplated that in embodiments of the invention, the components of the liquid auxiliary tank 130 that contact the water are food grade, food safe or drinking water safe materials, such as but not limited to stainless steel materials and/or alloys and plastic materials. Further, the flanges 139 can be connected to one another by a variety of methods. For example, the flanges 139 can, but need not, be sonic welded to one another, can but need not include cooperating portions (e.g., cooperating protrusions and voids opposite one another), and can but need not be crimped to one another. The liquid auxiliary tank 130 can, but need not, include one or more brackets, spot or otherwise welded to an exterior of the liquid auxiliary tank 130, for mounting the liquid auxiliary tank 130 in the refrigerator 200.

FIG. 4 is a partial cross sectional view of an embodiment of the liquid storage tank 140. It is to be understood that although the figure shows a particular embodiment of the liquid storage tank 140, the liquid storage tank 140 is not required to include any or all of the illustrated components. Rather the liquid storage tank 140 can include none or one or more of these components, and/or can include other components, as long as the liquid storage tank 140 can retain the water flowing into the liquid dispensing apparatus 100, before the water is dispensed.

As shown in the figure, the liquid storage tank 140 includes a liquid inlet 141, through which the water is received into the liquid storage tank 140, and a liquid outlet 143 through which the water is delivered from the liquid storage tank 140. Each of the liquid inlet and outlet 141 and 143 can be about ¼ inches (0.64 cm) diameter tubing, with a wall thickness of about 0.028 inches (0.07 cm) or another wall thickness. At least the liquid inlet 141 can have an about 90 degree bend, such that the water received in the liquid inlet 141 flows along a bottom of the liquid storage tank 140. One of, or each of, a thermistor 145 and a bi-metal thermostat 147 can be used, in a manner known to those of ordinary skill in the art and in the manner described above, to regulate a temperature of the water in the liquid storage tank 140. A bracket of the bi-metal thermostat 147 can be spot welded to an exterior of the liquid storage tank 140.

A tubular heater 148, which is a 500 watt, 115 volt heater with an exterior formed of INCOLOY 800, can be used to heat the water in the liquid storage tank 140, in a manner known to those of ordinary skill in the art and in the manner described above.

One or more, such as two, sub plates 149 can be disposed in the interior of the liquid storage tank 140. The two sub plates 149 can be made from 25 gage metal, each with one or more about 0.05 inches (0.13 cm) diameter holes formed therein or drilled therethrough. Each of the sub plates 149 can be tack welded in four places, and spot welded every 0.5 inches (1.3 cm), along each of the sides of the sub plates 149. The sub plates can help ensure even filling of the interior of the liquid storage tank 140, and can permit the water to be adequately heated before flowing to the liquid outlet 143.

A bottom plate, a top cap, and a remainder of a body of the liquid storage tank 140 can be made from 25 gage metal, and can include seam welds to make the body leak resistant or leak proof. Each of the bottom plate, the top cap, and the remainder of the body of the liquid storage tank, as well as the sub plates 149, can be made from 321 stainless steel. Although not shown in the drawings, one or more, such as two, brackets can be spot welded to the exterior of the liquid storage tank 140, for mounting of the liquid storage tank 140 in the refrigerator 200. The brackets can be made from 25 gage, 321 stainless steel. Although also not shown in the drawings, the liquid storage tank 140 can include a float valve mechanism that is used to indicate and control a level of the water in the interior of the liquid storage tank 140.

The heated water can be dispensed by the liquid dispensing apparatus 100 in various ways. By way of non-limiting examples, in certain embodiments, during delivery of the heated water by the liquid dispenser 150, the piston 133 moves in the liquid auxiliary tank 130, so that the heated water in the liquid auxiliary tank 130 is expelled therefrom and flows towards the liquid storage tank 140. This expulsion of the heated water from the liquid auxiliary tank 130 can occur prior to, or during a same time as, introduction of additional water into the liquid delivery apparatus 100, such as by the opening of the liquid valve 120. The heated water flows from the liquid storage tank 140 to the liquid dispenser 150, and is dispensed as discussed in detail above.

After dispensing of the heated water has concluded, the introduced water continues to flow into the liquid storage tank 140. The liquid valve 120 is then closed to prevent the further introduction of water into the liquid delivery apparatus 100. The piston moves in the liquid auxiliary tank 130, so that the water in the liquid storage tank 140 flows towards and into the liquid auxiliary tank 130. When heated water flows from the liquid storage tank 140 into the liquid auxiliary tank 130, the water in the liquid auxiliary tank 130 cools to ambient temperature. The water downstream of the liquid storage tank 140 and upstream of the liquid dispenser 150 flows back towards and/or into the liquid storage tank 140. By this arrangement, the liquid dispensing apparatus 100 provides one or more of the advantages that are discussed in detail above.

In the drawings and through out the description, the liquid auxiliary tank 130 is shown and described as separate from the liquid storage tank 140. It is to be understood, however, that the term "tank" and variations thereof encompass separate portions or chambers of a same tank or tank body.

This written description uses examples to disclose embodiments of the invention, including the best mode, and also to enable a person of ordinary skill in the art to make and use embodiments of the invention. It is understood that the patentable scope of embodiments of the invention is defined by the claims, and can include additional components occurring to those skilled in the art. Such other arrangements are understood to be within the scope of the claims.

The invention claimed is:

1. A method of selectively dispensing both heated water and cool water from a liquid dispensing apparatus comprising a liquid dispenser disposed in a door of a refrigerator, the liquid dispensing apparatus further comprising a water inlet, a first storage tank in fluid communication with the water inlet for retaining and heating water from the water inlet, a second storage tank in fluid communication with the water inlet for retaining water from the water inlet, an auxiliary tank in fluid communication with the water inlet and in two-way fluid communication with the first storage tank, the auxiliary tank comprising a housing and a piston disposed in the housing and movable in opposite first and second directions, the liquid dispenser being disposed downstream of and in fluid communication with each of the first storage tank and the second storage tank, the method comprising:

at least partially filling the first storage tank with water from the water inlet;

moving the piston in the first direction to fill at least part of the housing with water from the first storage tank and to pull water away from the liquid dispenser to the first storage tank;

heating water in the first storage tank;

at least partially filling the second storage tank with water from the water inlet;

dispensing water from the liquid dispenser when the liquid dispenser is activated to dispense cooled water; and moving the piston in the second direction to expel water from the housing and push water towards the liquid dispenser when the liquid dispenser is activated to dispense heated water.

2. The method of claim 1, further comprising: disposing a bladder in an interior volume of the housing, the bladder being configured to form a fluid tight seal with the housing and move in response to movement of the piston.

3. The method of claim 1, further comprising:

cooling the water in the second storage tank to a temperature less than a temperature at which water is received into the second storage tank.

4. The method of claim 1, wherein the movement of water away from the first storage tank to the auxiliary tank pulls water away from the liquid dispenser.

5. The method of claim 1, wherein the auxiliary tank is disposed downstream of the water inlet and upstream of the first storage tank.

6. The method of claim 1, wherein the liquid dispenser comprises a single liquid dispensing tube in fluid communication with each of the first storage tank and the second water storage tank.

7. The method of claim 1, further comprising, after dispensing heated water from the liquid dispenser, moving the piston in the first direction to fill at least part of the housing with water from the first storage tank and to pull water away from the liquid dispenser towards the first storage tank.

8. The method of claim 1, wherein movement of the piston in the first direction increases a volume of an interior of the housing and movement of the piston in the second direction decreases the volume of the interior of the housing.

9. The method of claim 1, further comprising closing the water inlet prior to moving the piston in the first direction to fill at least part of the housing with water from the first storage tank.

10. The method of claim 9, further comprising opening the water inlet after moving the piston second direction to allow water to flow into the first storage tank.

11. The method of claim 1, further comprising closing the water inlet and moving the piston in the first direction to fill at least part of the housing with water from the first storage tank and to pull water away from the liquid dispenser towards the first storage tank after the liquid dispenser is no longer activated to dispense heated water.

12. The method of claim 1, further comprising disposing a sealing member on the piston to form a fluid tight seal between the piston and an interior of the housing.

13. The method of claim 1, further comprising receiving water into the first storage tank through a first inlet and delivering water from the first storage tank to the liquid dispenser through a second inlet, the first inlet being separate from the second inlet.

14. The method of claim 13, further comprising receiving water through the first inlet along a bottom portion of the first storage tank and delivering water through the second inlet from a top portion of the first storage tank.

15. The method of claim 14, further comprising disposing a sub-plate in the bottom portion of the first storage tank above the first inlet.

16. The method of claim 1, further comprising heating the water in the first storage tank with a liquid heater.

17. The method of claim 16, wherein the liquid heater is a submersible liquid heater.

* * * * *